US006200063B1

(12) United States Patent
Fritzinger

(10) Patent No.: US 6,200,063 B1
(45) Date of Patent: Mar. 13, 2001

(54) GUIDE BARRIER SYSTEM, ESPECIALLY FOR SECURING TRAFFIC ROADS

(75) Inventor: Klaus Fritzinger, Birnstrasse 8, D-67655, Kaiserslautern (DE)

(73) Assignee: Klaus Fritzinger, Kaiserlautern (DE)

( * ) Notice: Subject to any disclaimer, the term of this patent is extended or adjusted under 35 U.S.C. 154(b) by 0 days.

(21) Appl. No.: 09/242,178

(22) PCT Filed: Aug. 2, 1997

(86) PCT No.: PCT/EP97/04224

§ 371 Date: Feb. 5, 1999

§ 102(e) Date: Feb. 5, 1999

(87) PCT Pub. No.: WO98/06903

PCT Pub. Date: Feb. 19, 1998

(30) Foreign Application Priority Data

Aug. 8, 1996 (DE) ..... 196 32 026

(51) Int. Cl.[7] ..... E01F 13/00; E01F 13/04

(52) U.S. Cl. ..... 404/6; 404/9; 256/13.1

(58) Field of Search ..... 409/6, 9, 10; 47/33; 116/63 C, 63 P; 362/162; 256/13.1

(56) References Cited

U.S. PATENT DOCUMENTS

| | | | | |
|---|---|---|---|---|
| 3,938,465 | * | 2/1976 | Lyons | 116/63 P |
| 4,515,499 | * | 5/1985 | Furiate | 404/6 |
| 4,762,438 | * | 8/1988 | Dewing | 404/6 |
| 4,848,263 | * | 7/1989 | Grimm | 116/63 C |
| 5,199,375 | * | 4/1993 | Johson | 116/209 |
| 5,269,623 | * | 12/1993 | Hanson | 404/6 |
| 5,421,118 | * | 6/1995 | Bauer | 47/33 |
| 5,426,888 | * | 6/1995 | Gnaedig | 47/33 |
| 5,453,916 | * | 9/1995 | Tennis et al. | 362/152 |
| 5,605,413 | * | 2/1997 | Brown | 404/6 |
| 5,676,350 | * | 10/1997 | Galli et al. | 256/13.1 |

FOREIGN PATENT DOCUMENTS

| | | |
|---|---|---|
| 387 808 | 3/1989 | (AT) . |
| 388 006 | 4/1989 | (AT) . |
| 0 351 572 A2 | 1/1990 | (EP) . |
| 0 462 307 A1 | 12/1991 | (EP) . |
| 0 618 332 A1 | 10/1994 | (EP) . |
| 2 598 484 A1 | 11/1987 | (FR) . |
| 2 219 332 | 12/1989 | (GB) . |

* cited by examiner

*Primary Examiner*—Eileen D. Lillis
*Assistant Examiner*—Raymond W Addie
(74) *Attorney, Agent, or Firm*—McGlew and Tuttle, P.C.

(57) ABSTRACT

A guide barrier system, especially for forming or securing traffic roads with a plurality of guide sections, which are arranged in at least one row one behind the other and can be connected to one another, wherein each guide section has a middle piece which is directed essentially in parallel to the direction of the traffic road and is elastically deformable at right angles to its longitudinal axis. A plurality of supports extend essentially at right angles to the middle piece with support surfaces extending essentially symmetrically to the middle piece provided at the middle piece. The said support surfaces are arranged at mutually spaced locations from one another at the middle piece to achieve the deformability of the middle piece. Two respective, mutually adjacent guide sections can be detachably connected to one another by means of a coupling piece engaging spaces located between the supports.

23 Claims, 3 Drawing Sheets

Fig. 1
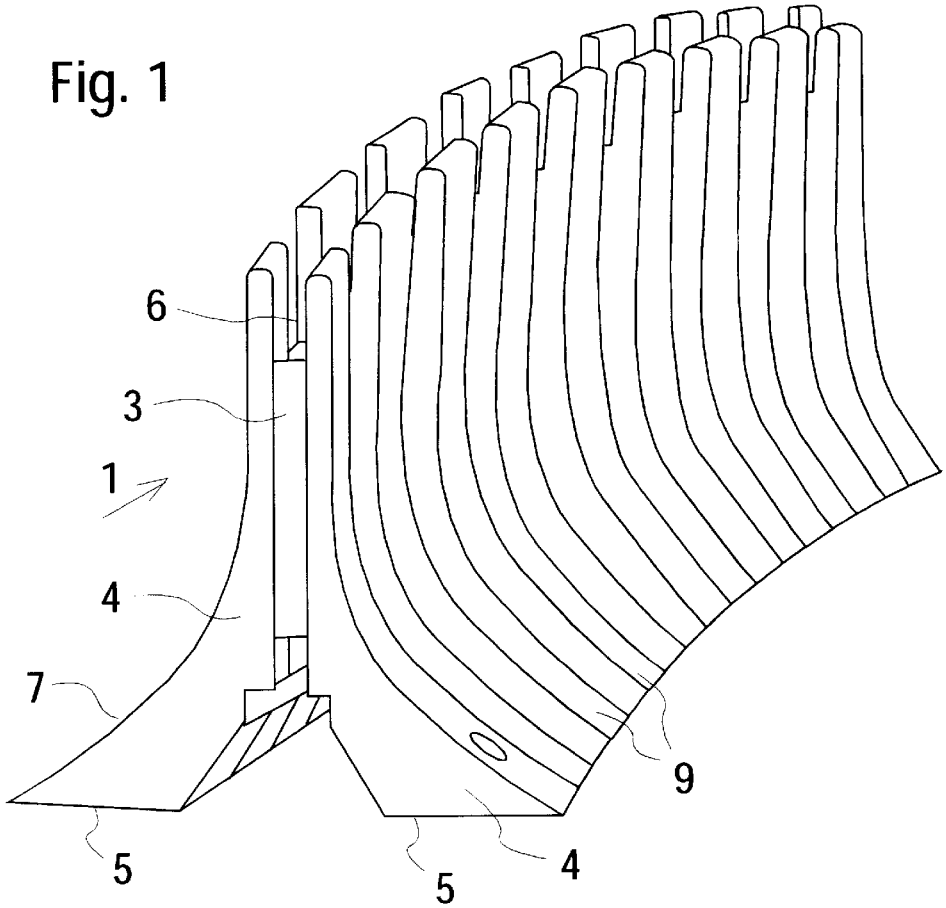
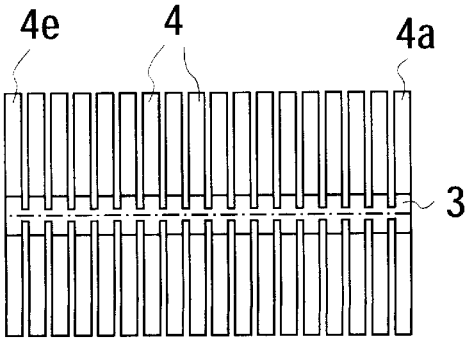
Fig. 3
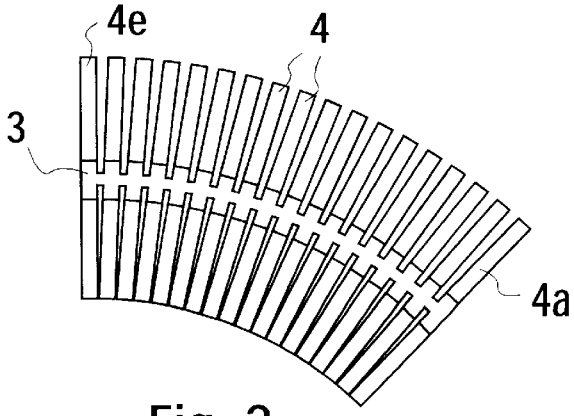
Fig. 2

Fig. 4
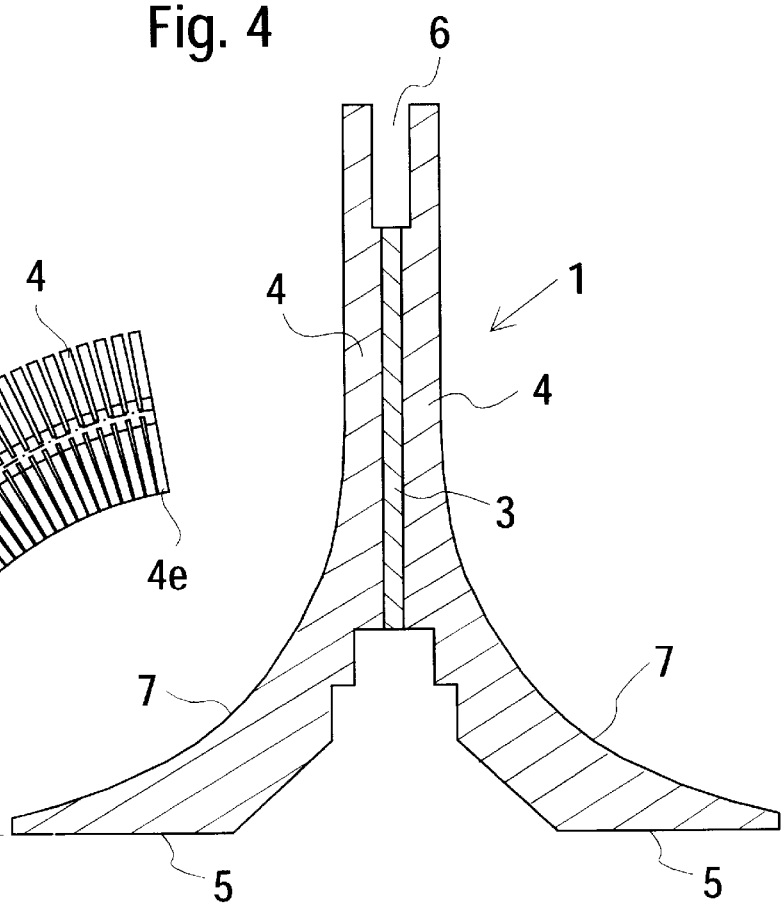
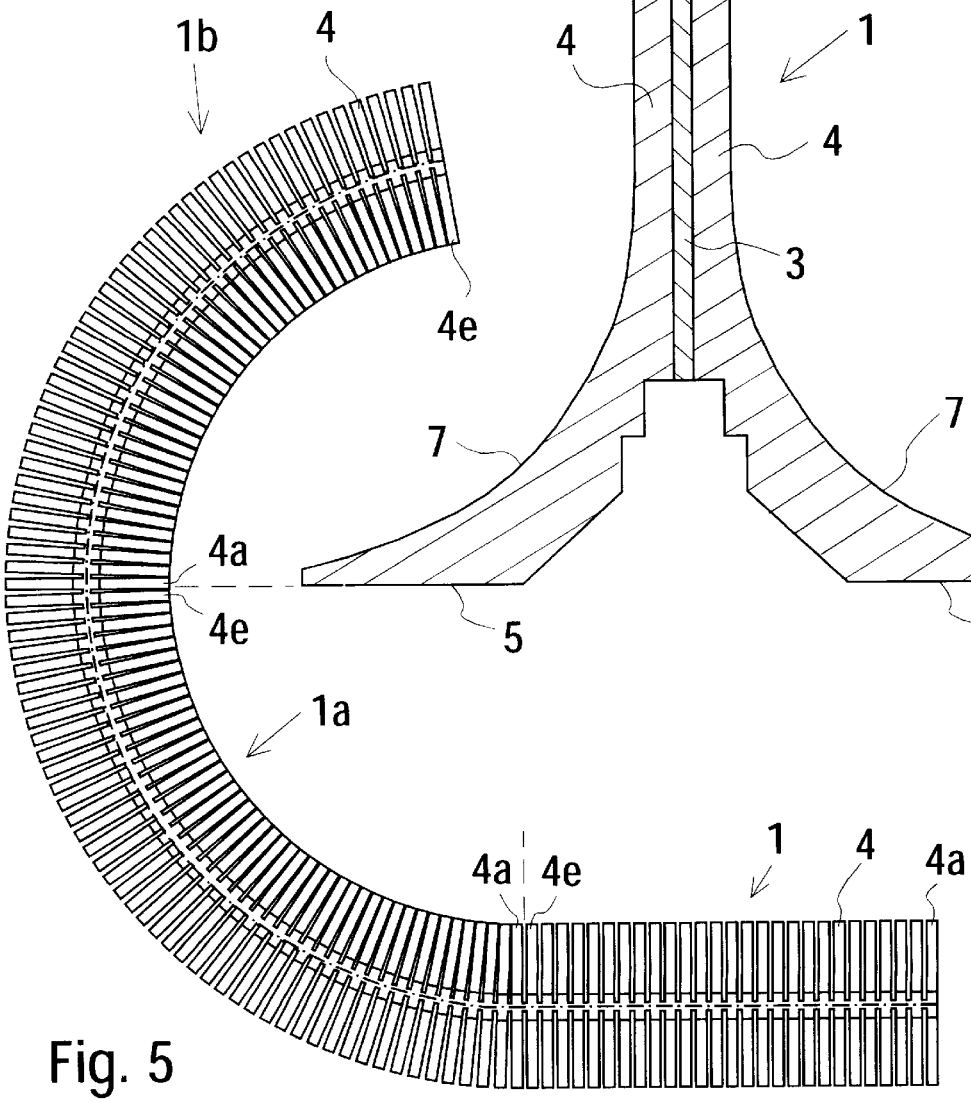
Fig. 5

GUIDE BARRIER SYSTEM, ESPECIALLY FOR SECURING TRAFFIC ROADS

FIELD OF THE INVENTION

The present invention pertains to a guide barrier system, especially for securing traffic roads.

The term "traffic road" is defined in the broadest sense of the word. Thus, the guide barrier system may be used to separate or secure traffic lanes at construction sites or squares, or to separate plant islands or plant boxes set up in the area of traffic roads. Such a guide barrier system may also be used to separate traffic lanes on turnpikes or in streets or to narrow traffic lanes, e.g., for speed reduction. Finally, such a guide barrier system may also be used inside large-area halls in order to form traffic roads, namely, lanes for so-called go-carts or similar motorized vehicles there as well.

BACKGROUND OF THE INVENTION

A guide barrier system is described in EP 0 618 332 A1, which is especially for forming or securing traffic roads with a plurality of guide sections which are arranged in at least one row one behind the other and can be connected to one another.

The guide barrier system according to this publication is formed essentially by a plurality of guide sections arranged one behind the other and connected to one another. These guide sections are designed such that the end of a first guide section can be connected to the beginning of the next guide section following it. To make do with a single shape of guide sections, these have a tenon-like projection at one of their ends, and a bearing eye-like projection for accommodating the given tenon at their other end. The two projections are designed and arranged at the guide section such that the tenon of a respective succeeding guide section is introduced from the top into the bearing eye-like projection of a preceding guide section.

Even though the guide sections thus designed can be mounted relatively easily to form a guide barrier system, such a guide barrier system does have the drawback that, e.g., when a guide section is replaced, this guide section cannot be readily removed from the guide barrier system. Rather, it is necessary to remove all guide sections up to the guide section to be replaced from the end of the guide barrier system; the damaged guide section can be replaced only thereafter.

If an area that is closed in itself is to be delimited with the above-described guide barrier system, which may happen, e.g., to delimit a traffic island, a planted area or to delimit a lane for a go-cart racetrack, difficulties will arise with the guide sections of the above-described guide barrier system because a specially designed end piece is necessary for closing such an area or the racetrack, or the last guide section can be mounted under difficult conditions only.

SUMMARY AND OBJECTS OF THE INVENTION

The primary object of the present invention is to provide a guide barrier system of this type, which makes possible a rapid replacement of damaged guide sections, on the one hand, and is flexible in shaping the lane, on the other hand, while guaranteeing uniform guide sections.

This object is accomplished with a guide barrier system of this type by each guide section having a middle piece that is directed essentially in parallel to the direction of the traffic road and is elastically deformable at right angles to its longitudinal axis, and by a plurality of supports extending at right angles to the middle piece being arranged at the middle piece, wherein the supports have support surfaces arranged symmetrically to the middle piece and the support surfaces are arranged at mutually spaced locations from one another on the said middle piece to achieve the deformability of the middle piece, wherein two mutually adjacent guide sections can be detachably connected to one another by means of a coupling piece engaging gaps located between the supports.

Due to the teaching according to the present invention, according to which the middle piece is made elastically deformable and the supports are arranged at mutually spaced locations from one another at the middle piece, the entire guide section can be elastically deformed to any desired curved shape while maintaining a minimum radius, i.e., it can be bent into any desired curved shape and, if necessary, it can be fixed in this shape on a base. If the corresponding curved shape is composed of a plurality of guide sections, this shape can also be fixed at the same time with the coupling piece connecting two mutually adjacent guide sections, wherein the two flanges of the coupling piece engage the gaps located between the supports.

The arrangement of the gaps between the individual supports imparts on the guide section an ability to bend, on the one hand, and, on the other hand, a nearly uninterrupted bumping surface is obtained for the wheels of the vehicle that are on the outer side of the curve due to the formation of a curved shape on the side of the guide section facing the lane. The individual supports or the corresponding guide section are thus able to elastically absorb lateral forces of the vehicle, and the guide section may be elastically deformed under the action of such lateral forces and return into its starting position after the cessation of the lateral forces.

A design of the guide sections that is simple in terms of manufacturing technology is obtained due to the fact that the middle piece and the supports of every guide section are made in one piece.

To engage the coupling piece with the guide sections, each guide section has, in the area of the upper end, at least at its two front-side end areas, one recess each, which is directed essentially in parallel to its longitudinal axis and may extend over the length of its guide section in a preferred embodiment. In this case, the guide section may be shortened at any desired point and be inserted as an end piece or intermediate piece into the guide barrier system.

An advantageous embodiment of the coupling piece is obtained by the coupling piece having a web engaging the recess of the guide section, with flanges arranged at its front-side ends. To connect two guide sections, it is therefore only necessary to place the corresponding guide section close by to one another and to push the two flanges of the coupling piece into the mutually adjacent gaps of the guide sections to the extent that the web of the coupling piece will be located within the recesses of the guide sections. The two flanges extending into the gaps of the two guide section now assume the securing of the guide sections in their longitudinal direction, while the web engaging the recesses assumes the securing of the guide sections in the direction extending at right angles to their longitudinal direction. The guide sections can thus be connected to one another or guide sections can thus be connected to end pieces or intermediate pieces without the use of separate fastening means, e.g., bolts.

An embodiment of the guide sections that is favorable for the driving behavior is obtained by each support having a bumping surface, which begins with an oblique surface in the area of its support surface and continues in a convexly curved surface.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a perspective view of a guide section in a bent shape;

FIG. 2 is a top view of a guide section in the bent shape;

FIG. 3 is a top view of a guide section in a straight shape;

FIG. 4 is a sectional view of a guide section;

FIG. 5 is a top view of part of the guide barrier system with bent and straight guide sections.

DESCRIPTION OF THE PREFERRED EMBODIMENTS

Figure 6:
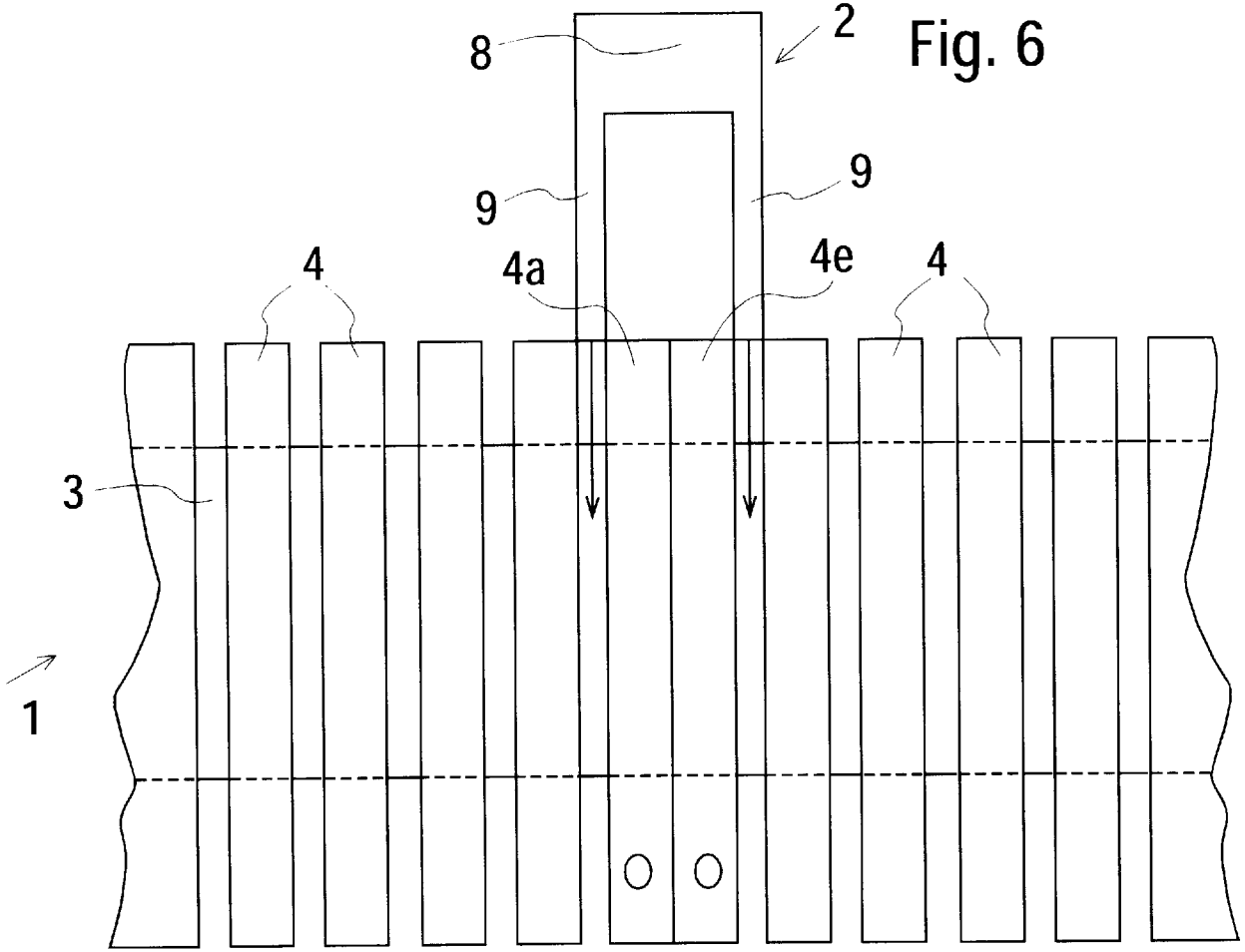
FIG. 6 is a front view of two guide sections with a coupling piece.

Referring to the drawings in particular, FIG. 1 shows a guide section 1 of the guide barrier system in the bent shape. Within the guide barrier system, the guide section 1 may assume either the bent shape shown in FIG. 2 or a straight shape, as is shown in FIG. 3. Straight and bent guide sections may be arranged in any desired order, and they can then be connected to one another by means of coupling pieces 2.

Since all guide sections 1 as well as all coupling pieces 2 of the guide barrier system have a respective identical design, the following description will be limited to one of these guide sections and to one of the coupling pieces.

The guide section 1 (FIG. 4) has a middle piece 3, which is oriented in the longitudinal direction of the guide barrier system and is manufactured from an elastically deformable material. The middle piece 3 has a preferably rectangular cross section, so that it can be elastically deformed relatively easily at right angles to its longitudinal axis, but is rigid in parallel to this longitudinal axis. Supports 4, which surround the middle piece 3 in their upper area and have support surfaces 5 arranged symmetrically to the middle piece 3 in their lower area, are provided at the guide section 1 at relatively closely spaced locations from one another. In a preferred embodiment, the middle piece 3 and the supports 4 are made in one piece.

FIG. 4 also shows that a recess 6 is provided at the supports 4 above the middle piece 3. The recess 6 may extend over the entire length of the guide section 1. The entire guide barrier system is highly flexible in this case insofar as only a corresponding length must be cut off from a guide section 1 to form end pieces or intermediate pieces, and the lengths cut off can be connected to a guide section 1 in the same manner as the guide sections 1 themselves.

In their lower area, the supports 4 have bumping surfaces 7 for the vehicle, which begin with an oblique surface each in the area of their support surfaces 5 and continue in convexly curved surfaces. The support surfaces 5 are also arranged symmetrically to the middle piece 3.

The coupling pieces 2 (FIG. 6) used to connect two guide sections 1 to one another or a guide section 1 to an end piece or an intermediate piece correspond essentially to the shape of a U and have a web 8, as well as two lateral flanges 9, which are arranged on the front sides of the web. To establish the connection of two guide sections 1 with one another or of one guide section 1 with an end piece or intermediate piece, the parts to be connected are placed with their front sides at closely spaced locations to one another. The coupling piece 2 with its two flanges 9 is subsequently introduced from the top over the supports of the two parts to be connected to one another to the extent that the web 8 is located within the recesses 6 of the guide sections 1 to be connected to one another. Since the lateral distance between the two flanges 9 of the coupling piece 2 corresponds to an integral multiple of the width of one support 4, the two flanges 9 assume the securing of the connection of the guide sections 1 in the longitudinal direction of the guide barrier system, while the web 8 extending into the recesses 6 assumes the securing of the guide barrier system in the direction extending at right angles to the guide barrier system.

To eliminate this connection, it is only necessary to pull the coupling piece 2 out of the area of the supports 4 in the upward direction. It is ensured as a result that a guide section 1 can be replaced, an additional one can be inserted, or one guide section can be removed in any desired area of the guide barrier system.

It appears from the above description that the course of the guide barrier system can be changed without a major effort. If, e.g., an additional loop is to be introduced into an elongated round course, it is only necessary to open this round course at a desired point and to insert the corresponding guide sections 1. To do so, the coupling pieces 2 connecting the guide sections 1 to be removed to one another are removed in the above-described manner; the guide sections 1 to be removed can then be removed.

The guide sections 1 necessary to form the loop can be introduced at the thus opened piece of the former round course. Since the loop has roundings, the guide sections are elastically deformed corresponding to these roundings before or during their introduction, i.e., their originally straight course is bent correspondingly. The guide sections 1 thus deformed are subsequently connected to one another and to the open ends of the former round course by introducing the coupling pieces 2. If the shape of the curvature formed during the deformation of the guide sections 1 is not smaller than a certain minimum radius, the shape of the loop thus formed is secured by the coupling pieces 2. The curved shape obtained may optionally also be fastened by fastening individual guide sections 1 on the ground. It is also conceivable to use coupling pieces 2 in which the distance between the flanges 9 corresponds to the sum of the widths of, e.g., four supports 4 and the two gaps enclosed by these supports 4 for fixing the curved course.

When forming, e.g., the sharp bend of the loop, there will be two arched sections having an inner radius each at the outer limitation of the lane. Due to the formation of the corresponding curvature, the bumping surfaces 7 of the individual supports 4 are aligned with the center of this curvature. The bumping surfaces 7 of the supports 4 facing the road were moved toward one another and are therefore in contact with one another almost uninterruptedly, so that the bumping surfaces 7 form a nearly uninterrupted limitation of the outside of the curve (FIGS. 2 and 5). If the vehicle bumps into the bumping surfaces 7, these absorb the lateral forces generated, and the corresponding guide section 1 is elastically deformed at first and returns to its original curved shape after the cessation of these lateral forces.

FIG. 5 also shows that the part of the guide barrier system shown there is formed by a total of three guide sections, namely, a straight guide section 1, a first arched guide section 1*a* and a second guide section 1*b* joining same.

FIG. 5 also shows that the respective last support 4*e* and the respective first support 4*a* of the guide sections 1, 1*a* and 1*b* are directly in contact with one another both at the inner radius of the road and at the outer radius facing away from the road and are aligned in parallel to one another, while the other supports 4 of the arched guide sections 1*a*, 1*b* are aligned exactly radially and at the outer radius and they are at a mutual distance from one another that is somewhat greater than the mutual distance between the supports 4 at the straight guide section 1.

It follows from the above explanations that the design of the guide sections 1 according to the present invention is suitable for limiting both the outer edge and the inner edge of the road of round courses and to elastically absorb, in particular, the lateral forces generated at the outer radius and for subsequently returning to its original shape.

Since, e.g., the guide sections 1 to be arranged in the area of the inner radius of a sharp bend are used only for the optical limitation of the road, i.e., they do not need to absorb and intercept any forces, it is also possible to provide in these areas guide sections that are provided with a support on one side of the middle piece only.

While specific embodiments of the invention have been shown and described in detail to illustrate the application of the principles of the invention, it will be understood that the invention may be embodied otherwise without departing from such principles.

What is claimed is:

1. A guide barrier system, comprising:

a plurality of guide sections which are arranged in at least one row one behind the other and can be connected to one another, each of said guide sections having a middle piece which is directed essentially in parallel to the direction of a traffic road and is elastically deformable at right angles to a longitudinal axis thereof, and a plurality of supports rigidly connected to said middle piece and extending at right angles to said middle peice, said supports of each of said guide sections only being connected to other supports of the same guide section through the rigid connection to said middle piece, said supports being arranged with support surfaces disposed at each side of said middle piece, essentially symmetrically to said middle piece, said support surfaces being arranged at mutually spaced locations from one another along the longitudinal axis of said middle piece to achieve a deformability of said middle piece; and a coupling piece wherein two respective, mutually adjacent guide sections can be detachably connected to one another parts of said coupling piece engaging spaces located between said supports of the two respective guide sections.

2. The guide barrier system in accordance with claim 1, wherein said middle piece and said supports of each said guide section are made in one piece.

3. The guide barrier system in accordance with claim 1, wherein in an area of an upper end of each of said guide sections, a recess is provided directed essentially in parallel to a guide section longitudinal direction.

4. The guide barrier system in accordance with claim 3, wherein each said recess extends over an entire length of a respective one of said guide sections.

5. The guide barrier system in accordance with claim 1, wherein said coupling piece has a web engaging each said recess and said parts include a first flange connected by said web to a second flange.

6. The guide barrier system in accordance with claim 5, wherein a distance between said said first flange and said second flange corresponds to an integral multiple of a thickness of one said support.

7. The guide barrier system in accordance with claim 1, wherein said support has a bumping surface, which begins with an oblique surface in an area of said support surface and continues in a convexly curved surface.

8. The guide barrier system in accordance with claim 2, wherein said support has a bumping surface, which begins with an oblique surface in an area of said support surface and continues in a convexly curved surface.

9. A guide barrier system for forming or securing traffic roads, the guide barrier system comprising:

a first guide section having a middle piece formed of a material which is elastically deformable at right angles to a longitudinal axis thereof and a plurality of support elements, each support element being fixed to said middle piece including a plurality of support elements extending at right angles to said middle piece from one side of said middle piece and a plurality of said support elements extending at right angles to said middle piece from the other side of said middle piece, the support elements being arranged substantially symmetrically to said middle piece, each of said support elements having a ground surface engaging portion, said support surfaces being arranged at said middle piece at mutually spaced locations from one another along the longitudinal axis of said middle piece and being movable relative to each other while connected to said middle piece to achieve a deformability of said middle piece at right angles to the longitudinal axis thereof;

a second guide section having a second guide section middle piece formed of a material which is elastically deformable at right angles to a longitudinal axis thereof and a plurality of second guide section support elements, each second guide section support element being fixed to said second guide section middle piece including a plurality of second guide section support elements extending at right angles to said second guide section middle piece from one side of said middle piece and a plurality of said second guide section support elements extending at right angles to said second guide section middle piece from the other side of said second guide section middle piece, said second guide section support elements being arranged substantially symmetrically to said second guide section middle piece, each of said second guide section support elements having a ground surface engaging portion, said second guide section support surfaces being arranged at said second guide section middle piece at mutually spaced locations from one another along the longitudinal axis of said second guide section middle piece and being movable relative to each other while connected to said second guide section middle piece to achieved a deformability of said middle piece relative to the longitudinal axis thereof; and a coupling piece with a first part extending into a space defined between two adjacent support elements of said first guide section and a second part extending into a space defined between two adjacent second guide section support elements of said second guide section wherein providing a detachable connection between said first guide section and said second guide section.

10. The guide barrier system in accordance with claim 9, wherein said middle piece and said support elements of said first guide section are made in one piece and said second guide section middle piece and said second guide section support elements of said second guide section are made in one piece.

11. The guide barrier system in accordance with claim 9, wherein said first guide section has un upper end with a recess.

12. The guide barrier system in accordance with claim 11, wherein said recess extends over an entire length of said guide section.

13. The guide barrier system in accordance with claim 12, wherein said coupling piece first part is a first flange and said second part is a second flange, said coupling piece including a web connecting said first flange to said second flange, said web being positioned in said recess.

14. The guide barrier system in accordance with claim 12, wherein a distance between said two flanges corresponds to an integral multiple of a thickness of one said support element.

15. The guide barrier system in accordance with claim 9, wherein said support element has a bumping surface with a lower oblique surface portion adjacent to said ground surface engaging portion and an upper oblique surface portion adjacent to said upper end and a convexly curved surface portion connecting said lower oblique surface portion to said upper oblique surface portion.

16. The guide barrier system in accordance with claim 10, wherein said support element has a bumping surface with a lower oblique surface portion adjacent to said ground surface engaging portion and an upper oblique surface portion adjacent to said upper end and a convexly curved surface portion connecting said lower oblique surface portion to said upper oblique surface portion.

17. A guide barrier system, comprising:

a plurality of guide sections which are arranged in at least one row one behind the other and can be connected to one another, each of said guide sections having a middle piece having a longitudinal extent essentially in parallel to a traffic flow direction, and a plurality of supports each connected to the middle piece and extending outwardly from said middle piece, each of said supports having a ground engaging surface, said supports being disposed at each side of said middle piece, essentially symmetrically to said middle piece, said supports being arranged at mutually spaced locations from one another and each support of a guide section being connected to the middle piece of the guide section with each guide section ground engaging surface being movable relative to the other supports of the guide section along the ground surface, with said middle piece being elastically deformable at right angles to a longitudinal axis of said middle piece for movement of the supports; and a coupling piece wherein two respective, mutually adjacent guide sections can be detachably connected to one another parts of said coupling piece engaging spaces located between said supports of the two respective guide sections.

18. The guide barrier system in accordance with claim 17, wherein said middle piece and said supports of each said guide section are made in one piece.

19. Thee guide barrier system in accordance with claim 17, wherein in an area of an upper end of each of said guide sections, a recess is provided directed essentially in parallel to a guide section longitudinal direction.

20. The guide barrier system in accordance with claim 19, wherein each said recess extends over an entire length of a respective one of said guide sections.

21. The guide barrier system in accordance with claim 19, wherein said coupling piece has a web engaging each said recess and said parts include a first flange connected by said web to a second flange.

22. The guide barrier system in accordance with claim 21, wherein a distance between said said first flange and said second flange corresponds to an integral multiple of a thickness of one said support.

23. The guide barrier system in accordance with claim 17, wherein said support has a bumping surface, which begins with an oblique surface in an area of said support surface and continues in a convexly curved surface.

* * * * *

UNITED STATES PATENT AND TRADEMARK OFFICE

CERTIFICATE OF CORRECTION

PATENT NO. : 6,200,063 B1
DATED : March 13, 2001
INVENTOR(S) : Klaus Fritzinger

It is certified that error appears in the above-identified patent and that said Letters Patent is hereby corrected as shown below:

Title page,
Item (30) Foreign Application Priority Data
August 6, 1996 (DE) 196 32 026

Signed and Sealed this

Twenty-first Day of August, 2001

*Attest:*

Nicholas P. Godici

NICHOLAS P. GODICI
*Acting Director of the United States Patent and Trademark Office*

*Attesting Officer*